US010400702B2

(12) United States Patent
Uphues

(10) Patent No.: US 10,400,702 B2
(45) Date of Patent: Sep. 3, 2019

(54) ENGINE FUELING DURING EXIT FROM A DECELERATION FUEL SHUT-OFF CONDITION

(71) Applicant: Ford Global Technologies, LLC, Dearborn, MI (US)

(72) Inventor: Marc G. Uphues, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 167 days.

(21) Appl. No.: 15/466,745

(22) Filed: Mar. 22, 2017

(65) Prior Publication Data

US 2018/0274474 A1 Sep. 27, 2018

(51) Int. Cl.

| | |
|---|---|
| ***F02D 41/30*** | (2006.01) |
| ***F02B 17/00*** | (2006.01) |
| ***F02D 41/12*** | (2006.01) |
| ***F02D 41/24*** | (2006.01) |
| ***F02D 41/26*** | (2006.01) |
| ***F02D 41/40*** | (2006.01) |
| ***F02P 5/15*** | (2006.01) |
| ***F02D 41/14*** | (2006.01) |
| ***F02D 35/02*** | (2006.01) |
| ***F02P 5/04*** | (2006.01) |
| ***F02D 41/38*** | (2006.01) |

(52) U.S. Cl.

CPC ..... *F02D 41/307* (2013.01); *F02B 17/005* (2013.01); *F02D 35/023* (2013.01); *F02D 41/126* (2013.01); *F02D 41/1454* (2013.01); *F02D 41/1475* (2013.01); *F02D 41/2429* (2013.01); *F02D 41/2451* (2013.01); *F02D 41/26* (2013.01); *F02D 41/3029* (2013.01); *F02D 41/401* (2013.01); *F02P 5/045* (2013.01); *F02P 5/15* (2013.01); *F02P 5/1504* (2013.01); *F02D 2041/389* (2013.01); *F02D 2200/101* (2013.01); *F02D 2200/1002* (2013.01)

(58) Field of Classification Search

USPC ..... 701/105

See application file for complete search history.

(56) References Cited

U.S. PATENT DOCUMENTS 5,988,137 A * 11/1999 Tamura ..... F02D 41/0002 123/295
5,992,372 A 11/1999 Nakajima
6,085,717 A * 7/2000 Kamura ..... F02D 17/02 123/295

(Continued)

*Primary Examiner* — Joseph J Dallo
*Assistant Examiner* — Scott A Reinbold
(74) *Attorney, Agent, or Firm* — Julia Voutyras; McCoy Russell LLP

(57) ABSTRACT

Methods and systems are provided for fueling an engine of a vehicle during an exit from a deceleration fuel shut-off (DFSO) condition. In one example, a method may include fueling the engine using a compression stroke direct injection during the exit from the DFSO condition to reach a first engine torque threshold, and may further include increasing a separation between the compression stroke direct injection and a spark to gradually increase the engine torque to a second, higher engine torque threshold, and thereafter transitioning engine fueling from the compression stroke direct injection to an intake stroke direct injection. In this way, torque bumps may be reduced during DFSO exit.

18 Claims, 5 Drawing Sheets

(56) References Cited

U.S. PATENT DOCUMENTS

| | | | | |
|---|---|---|---|---|
| 6,209,526 | B1 * | 4/2001 | Sun | F02B 17/00 123/295 |
| 6,240,354 | B1 | 5/2001 | Yamada et al. | |
| 6,510,835 | B1 * | 1/2003 | Mizuno | F02D 41/123 123/295 |
| 2012/0118275 | A1 * | 5/2012 | Kang | F02D 41/0062 123/568.11 |

* cited by examiner

ENGINE FUELING DURING EXIT FROM A DECELERATION FUEL SHUT-OFF CONDITION

FIELD

The present description relates generally to methods and systems for fueling an engine of a vehicle during an exit from a deceleration fuel shut-off (DFSO) condition.

BACKGROUND/SUMMARY

Engines may be operated in a deceleration fuel shut-off (DFSO) condition to save fuel. Therein, fuel injectors are turned off while air continues to flow through the cylinders, and the engine is spun down with fuel disabled. Once the engine speed has sufficiently dropped, or in response to an increase in torque demand, the DFSO conditions may be exited wherein fuel delivery is resumed. During the DFSO exit, a torque bump may occur when the engine torque goes from negative (fuel shut off) to positive (fuel on). Further, when exiting from the DFSO condition, the engine may be operated with a rich air fuel ratio (AFR) to increase efficiency of exhaust catalysts that may have been saturated with oxygen when fuel was disabled. Due to the rich AFR, the engine torque output may increase, further exacerbating the torque bump. This can cause an undesirable and noticeable torque bump that passes through the drivetrain and can be perceived by the driver.

Example approaches to reduce torque bumps include changing a fuel injection mode. For example, in engines configured with direct fuel injection, fuel may be delivered via an intake stroke direct injection mode (also referred to as homogeneous mode) and/or a compression stroke direct injection mode (also known as stratified mode). In the intake stroke direct injection (DI) mode, the combustion chambers contain a substantially homogeneous mixture of air and fuel. In the compression stroke DI mode, the combustion chambers contain stratified layers of different air/fuel mixtures including a stoichiometric air/fuel mixture nearer the spark plug and lower strata containing progressively leaner air/fuel mixtures. Engine operation may be controlled when switching between the stratified and the homogeneous mode to deliver the demanded torque without adversely affecting driveability.

One example approach is shown by Yamada et al. in U.S. Pat. No. 6,240,354. Therein, to increase homogeneous charge and torque output, fuel is injected twice: once during the intake stroke and again during the compression stroke to reduce torque fluctuations.

However, the inventors herein have recognized potential issues with such an approach. As one example, using two injections, one during the intake stroke and the other during the compression stroke, results in a combustible mixture layer adjacent to a spark plug, while the rest of the combustion chamber contains a lean mixture. This generates a weak stratified charge combustion and may not be able to provide a large enough initial torque during DFSO exit conditions. As a result, the engine may stall during the DFSO exit. In addition, using two injections during a DFSO exit may require additional control and complexity to ensure accurate control of timing between the injections.

In one example, the issues described above may be addressed by a method for controlling engine torque, the method comprising: during an exit from a deceleration fuel shut-off (DFSO) condition, fueling an engine via a compression stroke direct injection (DI) at a first separation from a spark event until an engine torque reaches a first threshold, then increasing a separation between the compression stroke DI and the spark event until the engine torque reaches a second, higher threshold, and thereafter transitioning to engine fueling via an intake stroke DI. Herein, the first threshold may be a peak engine output torque that is determined prior to the DFSO exit, and may be sufficient to give the initial increase in torque that is needed when the engine exits from a DFSO condition. In this way, engine stalls may be avoided.

As one example, during selected engine operating conditions (e.g., light engine load conditions), an engine may be fueled using compression stroke direct injection to provide a stratified charge distribution inside a cylinder. When fueling using the compression stroke direct injection, a controller may learn a separation between a timing of the compression stroke direct injection and a spark event that generates a peak engine output torque (for the given conditions), the peak engine output torque then saved in the controller's memory as a first torque threshold. During a subsequent exit from a DFSO condition, the controller may fuel the engine using compression stroke direct injection while applying the learned separation between compression stroke direct injection timing and spark timing. Once the engine reaches the peak engine output torque, the separation between the compression stroke direct injection timing and the spark timing may be increased until a second torque threshold, higher than the first torque threshold, is reached. Thereafter the engine may be transitioned to being fueled via intake stroke direct injection.

In this way, an engine may be able to produce a previously learned peak engine output torque during an exit from DFSO conditions with reduced likelihood of stalls. The technical effect of increasing the separation between the timing of the compression stroke direct injection and the spark timing after the peak engine output torque is reached is that the resulting drop in engine torque may be used to offset the increase in engine torque that occurs as a result of operating the engine with a rich air fuel ratio (AFR) during a DFSO exit. Consequently, instead of encountering a noticeable torque bump, a gradual increase in torque is provided through the driveline which may not be objectionable to the driver. By transitioning the engine from being fueled via compression stroke direct injection to intake stoke direct injection after the engine torque has exceeded a threshold, the engine may be operated with a more homogeneous air/fuel mixture which is maintained at or near stoichiometry, thus enabling cleaner combustion and producing lower emissions. In this way, the engine may be transitioned out of DFSO with a smoother torque profile, thereby enhancing drivability.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
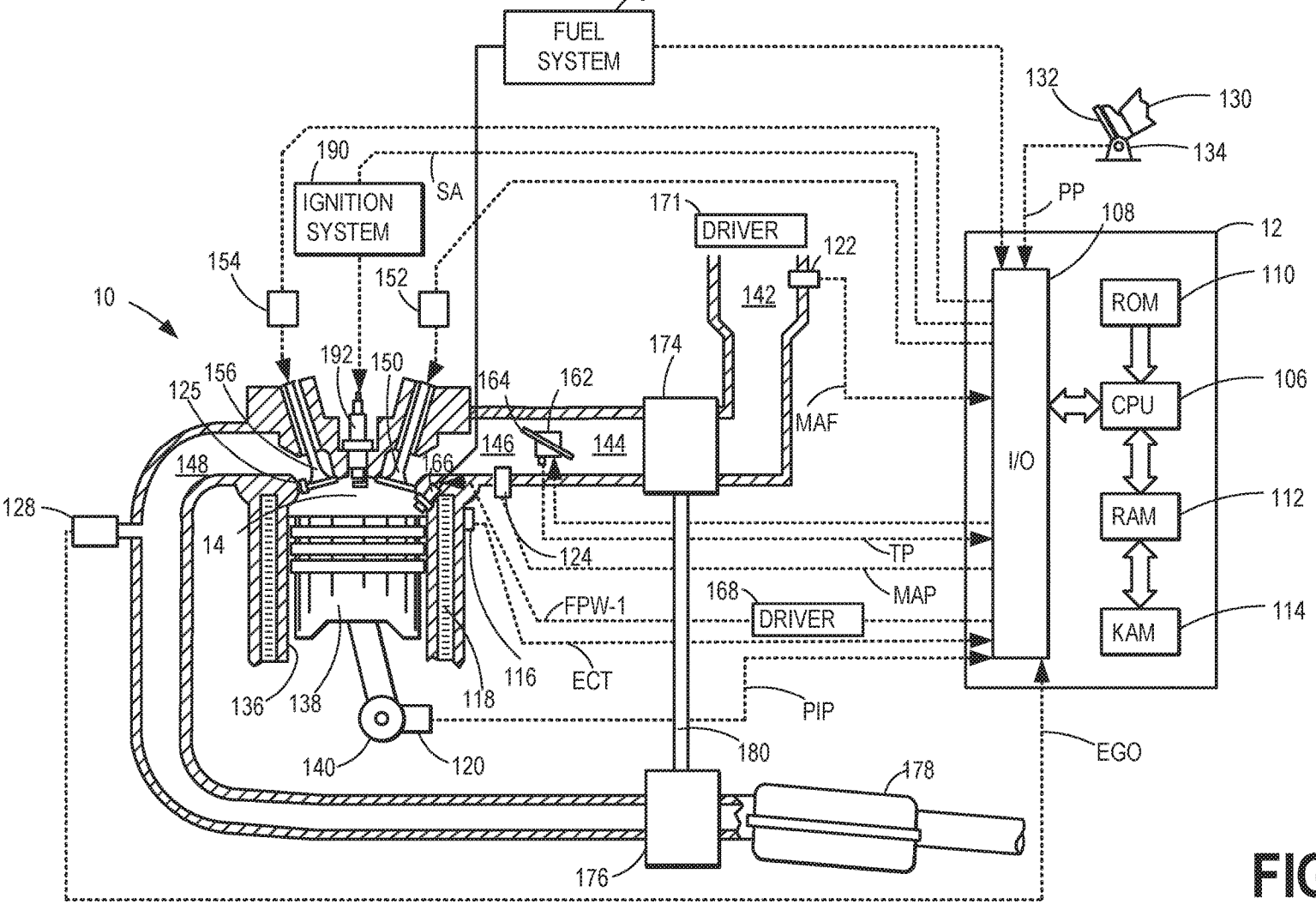
FIG. 1 schematically depicts an example embodiment of a cylinder of an internal combustion engine.
Figure 3:
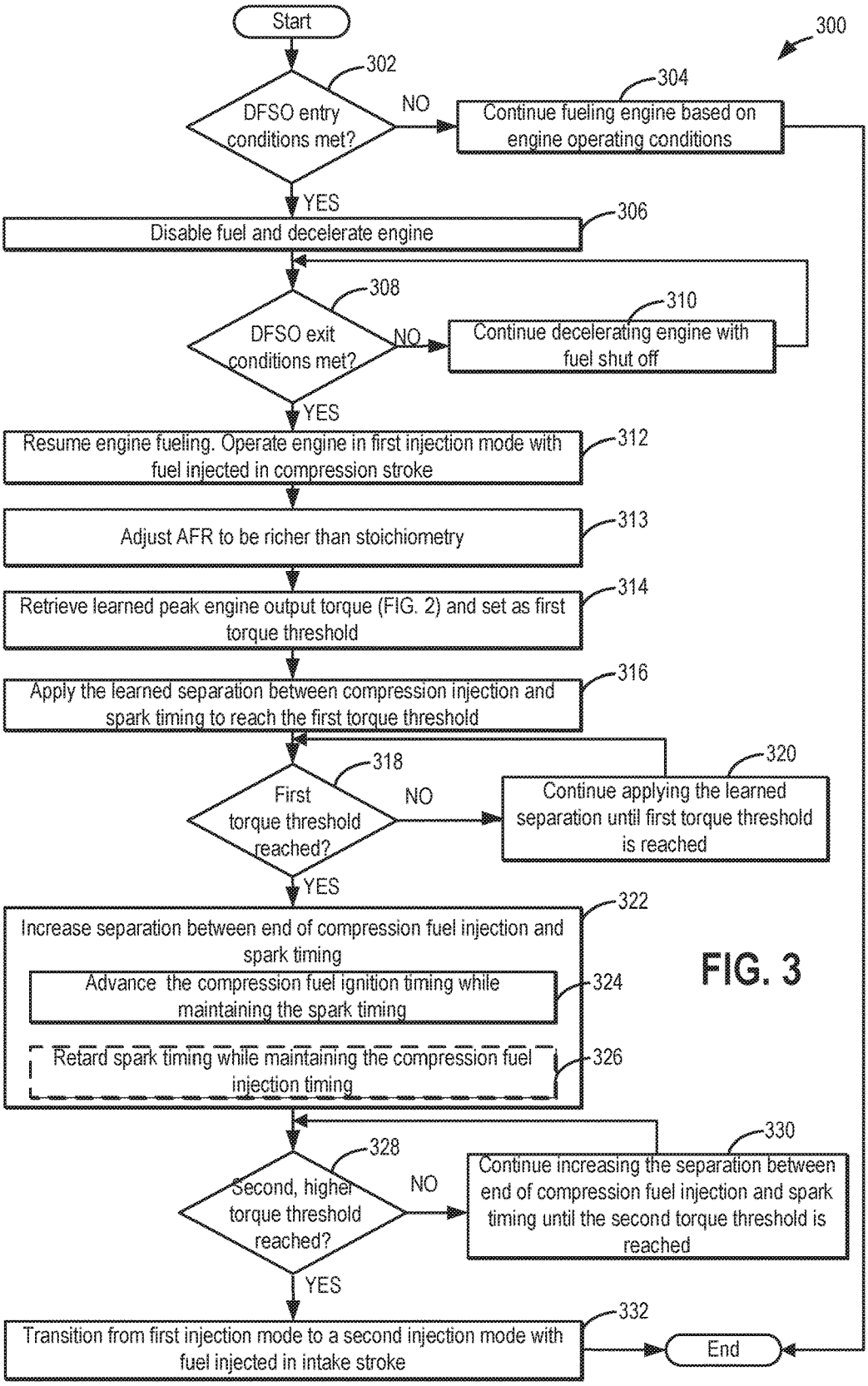
FIG. 3 depicts a high level flow chart of an example method for applying and updating the learned target separation during an exit from DFSO conditions, and transitioning fuel injection modes responsive to engine torque output following the DFSO exit, according to the present disclosure.
Figure 4:
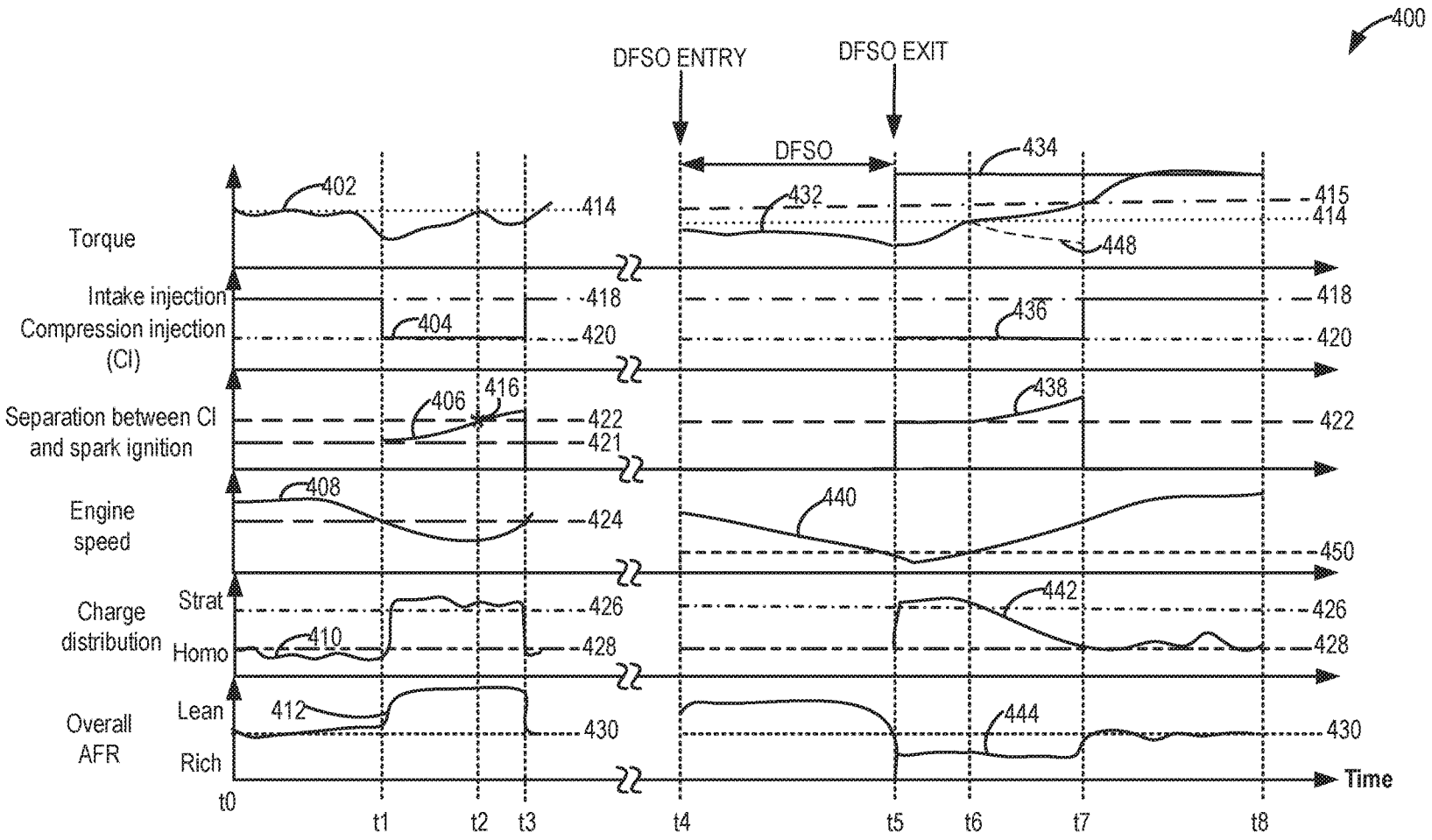
FIG. 4 depicts a prophetic example of engine adjustments applied during a DFSO exit to reduce torque bumps, according to the present disclosure.
Figure 5:
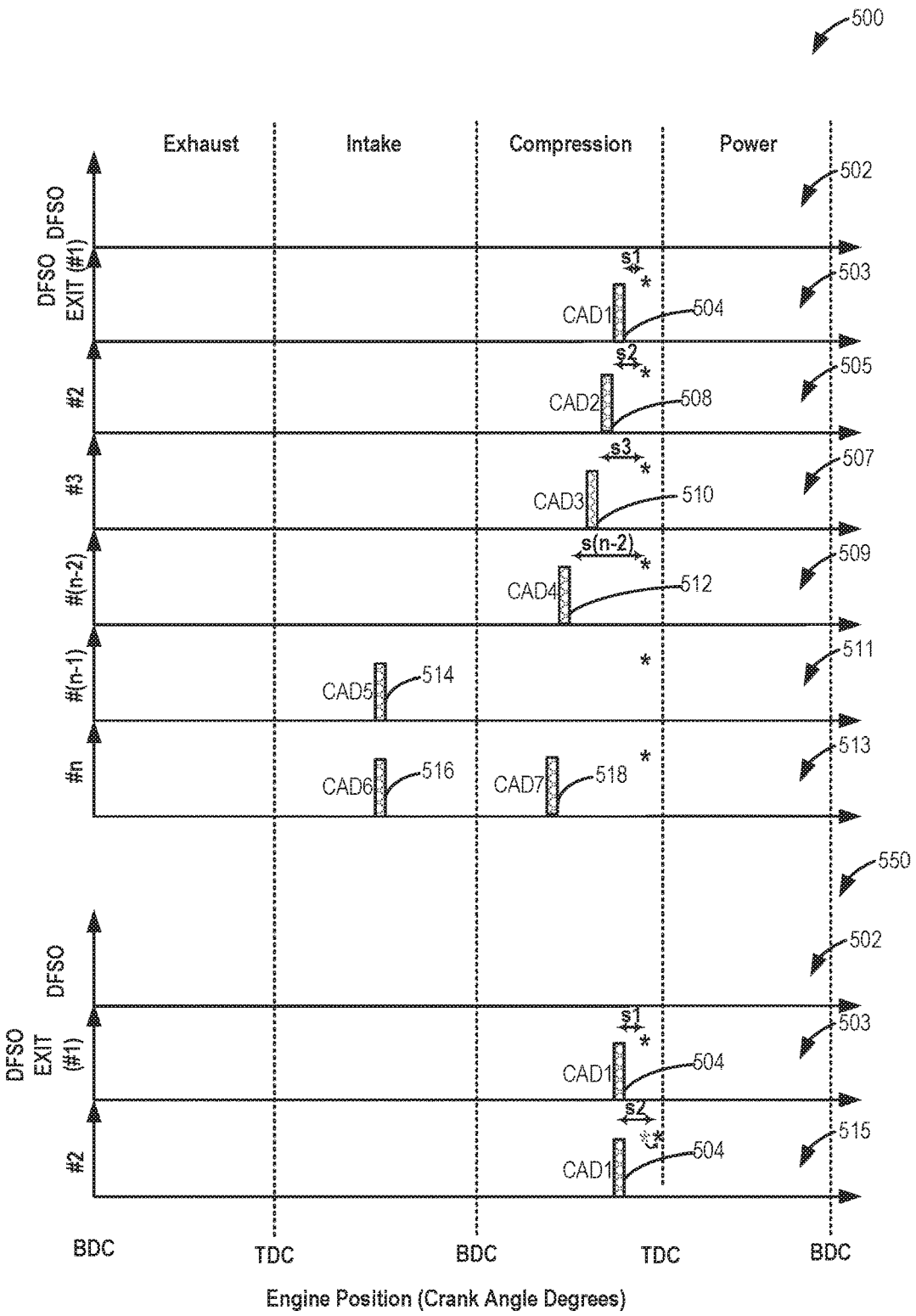
FIG. 5 shows example fuel injection profiles, including example separations between fuel injection timing and spark timing, which may be applied during a DFSO exit, according to the present disclosure.

The following description relates to systems and methods for adjusting a fuel injection mode to reduce torque bumps in an engine, such as in the engine system of FIG. 1. The engine may be fueled in a first injection mode via a compression stroke direct injection (DI) prior to a deceleration fuel shut-off (DFSO) event. An engine controller may be configured to perform a control routine, such as the example routine of FIG. 2, to learn a separation between a timing of the compression stroke DI and a timing of the spark event that results in a peak engine output torque, herein referred to as a first torque threshold. During a subsequent exit from DFSO conditions, the engine controller may be configured to perform a control routine, such the example routine of FIG. 3, to resume fueling the engine in the first injection mode via the compression stroke DI while applying the learned separation until the engine torque reaches the first threshold. Thereafter, the engine controller may gradually increase the separation, as shown at FIG. 5, to gradually decrease the engine torque output. Example fuel and spark timing adjustments that may be applied during a DFSO exit are shown at FIG. 4. In this way, an engine torque may be gradually increased during an exit from DFSO conditions, reducing torque bumps.

FIG. 1 depicts an example of a cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also referred to as "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10. An in-cylinder pressure sensor 125 may be installed inside the cylinder 14 of the engine 10 to detect a combustion pressure in the cylinder representative of an indicated mean effective pressure (IMEP).

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three-way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher-octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes.

In general, the spark plug may deliver an electric current to the combustion chamber of a spark-ignited engine to ignite an air-fuel mixture and initiate combustion. In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from fuel system 8. The fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may enhance mixing and combustion when operating the engine with an alcohol-based fuel due to the lower volatility of some alcohol-based fuels. Alternatively, the injector may be located overhead and near the intake valve to enhance mixing. Fuel may be delivered to fuel injector 166 from a fuel tank of fuel system 8 via a high-pressure fuel pump, and a fuel rail. Further, the fuel tank may have a pressure transducer providing a signal to controller 12.

In some examples, additional fuel injectors may be arranged in intake passage 146, rather than in cylinder 14, in a configuration that provides what is known as port injection of fuel into the intake port upstream of cylinder 14. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it may be appreciated that the fuel systems described herein may not be limited by the particular fuel injector configurations described herein by way of example.

Fuel may be delivered by fuel injector 166 to the cylinder during a single cycle of the cylinder. Further, the distribution and/or relative amount of fuel delivered, and injection timing may vary with operating conditions, such as a deceleration fuel shut-off (DFSO) exit condition, engine load, knock, and exhaust temperature, such as described herein below. The directly injected fuel may be delivered during an intake stroke, as well as partly during a previous exhaust stroke, during the intake stroke, and partly during the compression stroke, for example. As such, even for a single combustion event, injected fuel may be injected at different timings from the direct injector. Furthermore, for a single combustion event, multiple injections of the delivered fuel may be performed per cycle. The multiple injections may be performed during the compression stroke, intake stroke, or any appropriate combination thereof.

An engine controller, such as controller 12, may adjust a timing of cylinder fuel injection to operate cylinder 14 in one of a plurality of injection modes. For example, the controller may operate the cylinder in a first injection wherein a stratified air/fuel mixture is provided in the cylinder. As another example, the controller may operate the cylinder in a second injection mode wherein a homogeneous air/fuel mixture is provided in the cylinder. In the first injection mode, controller 12 activates fuel injector 166 during a compression stroke (e.g., towards the end of the compression stroke, such as at or around compression stroke TDC) so that fuel is sprayed directly into the bowl of piston 138. Hereafter, the first injection mode may also be referred to as the compression stroke direct injection. As a result of the late compression stroke fuel injection, stratified air/fuel layers may be formed in the cylinder. The strata closest to the spark plug contains a stoichiometric mixture or a mixture slightly rich of stoichiometry, and subsequent strata contain progressively leaner mixtures. However, an overall air/fuel ratio in the cylinder may be lean (leaner than stoichiometry) during the compression stroke direct injection.

Figure 2:
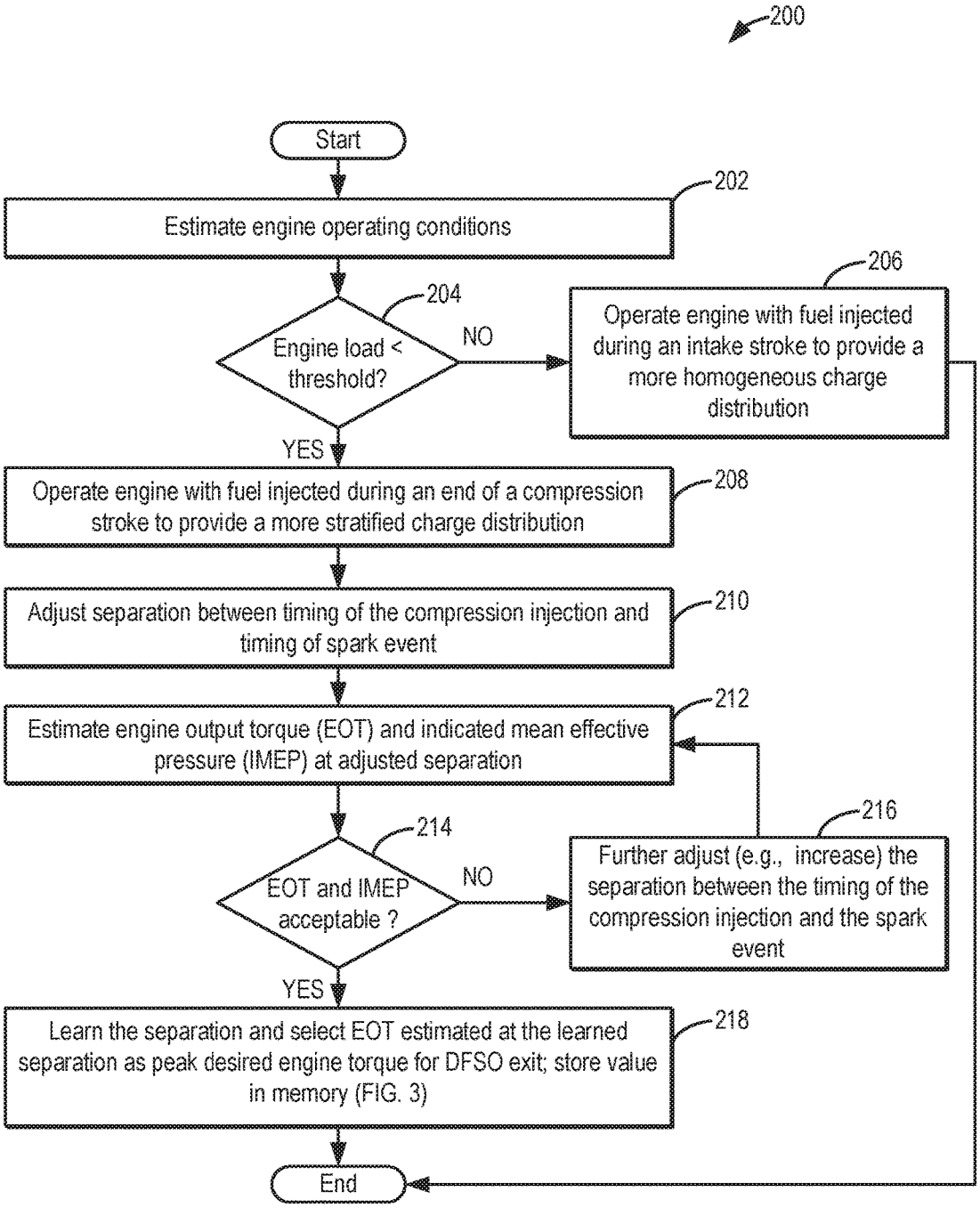
FIG. 2 depicts a high level flow chart of an example method for learning a target separation between a timing of a compression stroke direct injection and a timing of a spark event, according to the present disclosure.

During selected engine operating conditions (e.g., at light load, and lower engine speeds), the controller 12 may operate the engine in the first injection mode wherein the engine is fueled via the compression stroke DI. Additionally, the controller 12 may learn a separation between a timing of the compression stroke injection and a spark timing that results in engine torque reaching a threshold torque (e.g., a peak engine output torque) as shown in FIG. 2. The controller may store the learned separation in a memory of the controller and apply the learned separation at a later time, such as when the engine exits from a DFSO condition, for example, as shown in FIG. 3. Herein, when the engine exits from the DFSO condition, the controller may resume fueling the engine in the first injection mode by injecting fuel during the compression stroke. Further, the controller may retrieve and apply the separation between the timing of the compression stroke injection and the spark timing from memory until a first threshold torque output is reached. Once the first threshold torque output is reached, the controller may start increasing the separation between the timing of the compression stroke DI and the spark timing to gradually increase the overall torque output of the engine to a second, higher threshold. Thereafter, the controller 12 may transition engine fueling from the first injection mode to the second injection mode. In this way, the controller may adjust the transition from the first injection mode to the second injection mode to reduce torque bumps.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day-to-day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus.

Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; a proportional pedal position PP signal from the pedal position sensor 134, and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature determined from temperature sensor 116. Controller 12 may estimate an indicated mean effective pressure (IMEP) based on an output of the in-cylinder pressure sensor 125.

As one example, the controller 12 generates an engine speed from the PIP signal. When the engine speed falls below a threshold, the controller 12 may operate the engine in the first injection mode by injecting fuel at an end of the compression stroke. In another example, the controller may determine engine torque from the MAP sensor, and when the engine torque falls below a threshold torque, the controller may operate the engine using the first injection mode. Operating in the first injection mode may include fueling engine only during the compression stroke (e.g., not during the intake stroke).

As another example, while operating the engine in the first injection mode, the controller 12 may learn a separation between the compression injection and a spark that delivers a peak engine output torque. The controller 12 may store this separation and retrieve it during certain engine operating conditions as described below.

In still other examples, the controller 12 may determine if deceleration fuel shut-off (DFSO) entry conditions are met based on various vehicle and engine operating conditions. For example, the controller 12 may enter a DFSO condition responsive to a drop in operator torque demand. In response to DFSO entry conditions being met, the controller 12 may operate the engine without fuel injection (e.g., by disabling fuel injector 166) and with cylinder valves continuing to pump air through the cylinder. As a result of the DFSO condition, the engine may decelerate, unfueled.

During the DFSO, responsive to the engine speed falling below a threshold speed (and above a zero speed), the controller 12 may determine that DFSO exit conditions have been met. Accordingly, the controller may resume cylinder fueling by reactivating fuel injector 166, and resume operating the engine in the first injection mode wherein the fuel is delivered during the compression stroke of the engine cycle. In addition, the controller 12 may retrieve the separation previously learnt and use that separation between the timing of the compression stroke direct injection and the spark timing to reach a first torque threshold on the DFSO exit. Once the torque reaches the first threshold, the controller may start to gradually increase the separation between the timing of the compression stroke direct injection and the spark timing so that there is a gradual increase in engine torque (rather than a torque bump). In one example, the controller 12 may increase the separation by advancing the timing of the compression stroke direct injection. Once the engine torque reaches a second, higher threshold, the controller 12 may switch to the second fuel injection mode wherein the fuel is injected in the intake stroke. The controller 12 may additionally adjust a separation between a timing of the intake stroke direct injection and the spark timing as well as adjust an amount of fuel injection based on operator torque demand.

In further examples, when exiting the DFSO condition, a TWC (such as TWC 178 shown in FIG. 1) may need to reestablish Nitrogen Oxides (NOx) conversion efficiencies. The controller 12 may adjust the AFR to be richer than stoichiometry by adjusting fueling to improve NOx conversion efficiency.

Turning now to FIG. 2, an example method 200 for learning a target separation between compression stroke direct injection timing and spark timing is shown. Specifically, the method 200 includes learning the separation between the compression stroke direct injection and the spark that may be used as an initial separation during a subsequent exit from DFSO conditions. Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

Method 200 begins at 202 where the controller estimates and/or measures engine operating conditions. Engine operating conditions estimated may include engine speed, engine load, engine temperature, ambient conditions (such as ambient temperature, pressure, and humidity), operator torque demand, manifold pressure, manifold air flow, exhaust catalyst conditions, soak time, fuel temperature, spark plug temperature, boost pressure, etc.

Method 200 proceeds to 204 where it is determined if an engine load is lower than a threshold engine load (e.g., in a low engine load region of an engine speed-load map). As an example, it may be determined if engine load is less than 2 bar brake mean effective pressure (BMEP). The engine load may be estimated based on the output of one or more sensors such as a manifold absolute pressure (MAP) sensor, throttle position sensor (TPS), and engine speed sensor. Engine load may be lower than a threshold during conditions when operator torque demand is low, such as during an engine cold start, or during engine idle, for example.

If the engine load is lower than the threshold (e.g., "YES' at 204), then method 200 proceeds to 208 where the engine is operated in a first injection mode wherein fuel is directly injected into a cylinder at or towards the end of a compression stroke (herein also referred to as compression stroke direct injection). The first injection mode may be default injection mode applied at low engine load conditions. When the engine is fueled with compression stroke direct injection, a small isolated pocket or cloud of air/fuel mixture is created within the cylinder, directly below a spark plug (such as spark plug 192 shown in FIG. 1). When a spark event occurs in the cylinder, only this pocket or "stratified" cloud mixture ignites and combusts. The combustion of the stratified cloud of mixture is used to heat up the remaining air in the cylinder, thus producing expansion of the gas within the cylinder. In some examples, the compression stroke direct injection may also be referred to as a stratified injection mode or simply stratified mode.

If the engine load is higher than the threshold load (e.g., "NO" at 204), then method 200 proceeds to 206 where the controller operates the engine in a second fuel injection mode with fuel injected during an intake stroke of the engine cycle, to provide a more homogeneous charge distribution. The second mode of fuel injection wherein fuel is injected during the intake stroke may also be referred to as an intake stroke direct injection or homogeneous injection mode. In the second injection mode, fuel is direct injected during the intake stroke (while the air is being drawn into the cylinder). As a result, the fuel mixes with all of the air in the cylinder, resulting in complete mixing and homogenous air-fuel mixture formation. The controller may adjust a timing of the intake stroke fuel injection such the fuel injection occurs during an intake stroke of the engine cycle. For example, the controller may adjust the timing of the intake stroke direct injection to occur when the piston is between the top dead center (TDC) and the bottom dead center (BDC) of the intake stroke. Further, the controller may adjust a spark timing to produce a maximum brake torque (MBT), for example. Method 200 then exits.

Returning to 208, after the first injection mode is selected responsive to the engine load being below the threshold load, method 200 proceeds to 210 where the controller adjusts a separation between the timing of the compression stroke direct injection and a spark timing. The controller may adjust a timing of the compression stroke fuel injection such that the fuel injection occurs at an end of the compression stroke of the engine cycle. For example, the controller may adjust the timing of the compression stroke direct injection to occur when a piston (such as piston 138 shown in FIG. 1) is at or close to a top dead center (TDC) of the compression stroke. Further, the controller may adjust a spark timing (using SA signal of FIG. 1, for example) to occur at a threshold separation from the timing of the compression stroke direct injection. In one example, the spark timing may be adjusted to occur at a separation from the compression fuel injection timing to produce a maximum brake torque (MBT) or peak torque for the given operating conditions.

Adjusting the separation may include increasing the separation between the timing of the compression stroke direct injection and the spark timing. In one example, spark timing may be retarded while maintaining the timing of the compression stroke direct injection to increase the separation. In another example, the timing of the compression stroke direct injection may be advanced while maintaining the timing of the spark to increase the separation. The controller may incrementally increase the separation, such as by retarding the spark timing by 5 CAD at a time, or by advancing compression direct injection timing (towards compression stroke BDC) by 5 CAD at a time. A size of the incremental increase in separation may be adjusted so as to not to produce significant torque disturbances. At each incremental separation between the timing of the compression stroke direct injection and spark timing, the controller may monitor one or more engine parameters, as explained below.

After adjusting the separation, method 200 proceeds to 212, wherein the method 200 includes estimating one or more engine parameters indicative of an engine output at the adjusted separation, such as an engine output torque (EOT) and an indicated mean effective pressure (IMEP). The IMEP indicates a torque generated during combustion and represents the combustion efficiency of the engine. The controller may sense or calculate the IMEP for each cylinder and the IMEP for each driving cycle of the engine based on a combustion pressure signal received from a combustion pressure sensor (such as combustion pressure sensor 125 shown in FIG. 1).

Method 200 then proceeds to 214 where method 200 includes determining if the EOT and the IMEP are acceptable. In particular, it may be determined if the separation has resulted in a sufficiently large engine output. The EOT and the IMEP may be compared to corresponding thresholds to determine if they are acceptable. In one example, the EOT may be compared to a threshold torque. If the EOT is higher than the threshold torque, the EOT may be considered acceptable. The threshold torque may be estimated at a given spark advance, engine speed, and engine load. As a non-limiting example, the threshold torque may be set to 30 lb-ft. In another example, if the separation set at 210 causes IMEP to be within 3 bar to 4 bar, then the IMEP is considered acceptable. In another example, if the COV of IMEP is less than 10%, then COV of IMEP is considered to be acceptable. The controller may confirm that both EOT and IMEP are acceptable.

If at least one of the EOT and the IMEP are not acceptable (e.g., "NO" at 214), method 200 proceeds to 216 where the controller further adjusts (e.g., further increases) the separation between the timing of the compression stroke direct injection and the timing of the spark event. The method 200 then continues to reiterate steps 212 and 216 with the separation being continually adjusted until both the EOT and IMEP are in acceptable ranges.

If both the EOT and the IMEP are acceptable, then method 200 proceeds to 218 wherein the controller selects the EOT estimated at 212 as a (target) peak desired engine torque and stores the value of the peak desired engine torque in the controller's memory. During a subsequent exit from DFSO conditions, the controller may retrieve the learned peak desired engine torque from its memory and apply it as a target engine torque when resuming cylinder fueling, as elaborated at FIG. 3. In addition, the controller may learn the separation between the timing of the compression stroke direct injection and spark timing corresponding to the peak desired engine output torque, and apply this separation as an initial separation between the timing of compression stroke direct injection and spark timing to achieve the peak desired engine output torque during the subsequent exit from DFSO, as shown in FIG. 3. In one example, the controller may learn the peak torque as a function of the separation and further as a function of engine speed and load conditions at which the peak torque was produced. The learned separation and peak torque may be used to populate or update a look-up table stored in the controller's memory.

In one example, the learned separation may correspond to an optimal separation where engine pumping and heat losses are minimized. Further, the separation may be learned as the operating point where the peak engine output torque and the standard deviation in IMEP (or IMEP value) is acceptable at a given spark advance, engine speed, and engine load. As one example, the learned separation may be a maximum separation that can be used beyond which there may be losses in the system. For example, any increase in separation beyond the optimal separation learned at 212 may lead to a loss in engine output torque without a significant change in the standard deviation of IMEP, or loss of stratification. In addition, any additional change in separation may greatly increase the standard deviation of IMEP, leading to incomplete fuel evaporation, and flame kernel quenching.

Turning now to FIG. 3, an example method 300 for applying a learned separation (learnt at 210 of method 200, for example) during an exit from a deceleration fuel-shut off (DFSO) condition is shown. Specifically, the separation between a timing of a compression stroke direct injection and a spark event learnt during a previous engine fueling condition may be retrieved and applied as an initial separation during a current DFSO exit condition. In one example, the method of FIG. 3 may be performed as part of the method of FIG. 2, such as at 218.

Method 300 begins at 302 where the method includes determining if DFSO entry conditions are met. DFSO entry conditions may be determined based on various vehicle and engine operating conditions, such as a combination of one or more of operator torque demand, vehicle speed, engine speed, and engine load. In one example, DFSO entry conditions may be considered met responsive to operator torque demand being lower than a threshold. In another example, DFSO entry conditions may be considered met responsive to an operator taking their foot off the accelerator pedal without applying the brake pedal (e.g., during coasting maneuvers). In still another example, DFSO entry conditions may be considered met responsive to vehicle speed falling below a threshold, or vehicle travel on a downhill segment.

If DFSO entry conditions are not confirmed (e.g., "NO" at 302), then method 300 proceeds to 304 where the engine may continue to be fueled based on estimated engine operating conditions such as engine speed, engine load, operator torque demand, etc.

As an example, continuing to fuel the engine may include, when the engine load is below a threshold load (e.g., 4 bar), fueling the engine using a first injection mode where fuel is directly injected during a compression stroke. Operating the engine in the first injection mode may include injecting fuel at the end of the compression stroke to form a "stratified" rich mixture just below a spark plug. In other examples, if the engine speed is below a threshold speed (e.g., lower than 2200 rpm), or when lower engine torque is demanded, the engine may be fueled using the first injection mode with fuel directly injected during the compression stroke.

As another example, continuing to fuel the engine may include, when the engine load is higher than the threshold load, fueling the engine using a second, different injection mode where fuel is directly injected during an intake stroke. In other examples, when higher engine power is required or when the engine is operating at higher speeds (e.g., higher than 2200 rpm), the engine may be fueled using intake stroke direct injection to provide a homogeneous air fuel charge mixture. The controller may transition from the first injection mode to the second injection mode and vice versa based on engine operating conditions. Method 300 then ends.

If DFSO entry conditions are confirmed (e.g., "YES" at 302), then method 300 proceeds to 306 to decelerate the engine with fuel shut-off. As an example, fuel may be shut off by disabling cylinder fuel injectors while maintaining cylinder valve operation. During DFSO, the engine is operated without fuel injection while the engine rotates and pumps air through the cylinders.

Method 300 then proceeds to 308 where it is determined if DFSO exit conditions are met. DFSO exit conditions may be confirmed in response to an increase in operator torque command requiring resuming of cylinder fuel injection, responsive to operator depression of an accelerator pedal, or an anticipated increase in torque demand such as during vehicle travel on an uphill segment. In yet another example, DFSO exit conditions may be confirmed when the engine decelerates unfueled to below a threshold speed, below which the engine may shut down. If DFSO exit conditions are not met (e.g., "NO" at 310), then method 300 proceeds to 310 to continue decelerating the engine with fuel maintained shut off and with cylinder valve operation maintained. The engine then remains in the DFSO condition until DFSO exit conditions are met.

If DFSO exit conditions are met (e.g., "YES" at 308), then method 300 proceeds to 312 to resume fueling the engine Resuming fueling in the engine may include activating or enabling the fuel injectors which were previously deactivated at 306. When the fuel injectors are enabled, the controller may inject fuel into the engine in accordance with the first (default) fuel injection mode with fuel injected during the compression stroke.

Method 300 proceeds to 313, where the controller may adjust an air/fuel ratio (AFR) to be richer than stoichiometry. Herein, a TWC (such as TWC 178 shown in FIG. 1) may need to reestablish Nitrogen of Oxides (NOx) conversion efficiencies. The controller 12 may adjust the AFR to be richer than stoichiometry by adjusting fueling to improve NOx conversion efficiency.

Method 300 proceeds to 314, where the controller retrieves a previously learned target peak engine output torque (previously determined during fueled engine operation, at 218 of FIG. 2), and applies the peak engine output torque as a first torque threshold. Next at 316, the controller applies a previously learned separation between compression stroke fuel injection timing and spark timing, as previously determined during fueled engine operation at 218 of method 200, as an initial separation between the timing of the compression stroke direct injection and the spark event on the exit from DFSO. The learned separation may correspond to an optimal separation where engine pumping and heat losses are minimized. The initial separation may include an initial compression stroke fuel injection timing and an initial spark timing.

Method 300 then proceeds to 318, where it is determined if the engine output when operating in the first injection mode with the learned separation applied is at the first torque threshold. The first torque threshold may correspond to the peak engine output torque that was previously learned when operating with the learned separation between compression fuel injection and spark timing. By applying the learned separation as the initial separation between the compression stroke direct injection and the spark timing, the engine may be allowed to reach the first torque threshold with reduced torque losses due to incomplete fuel evaporation, and flame kernel quenching. Herein, the learned separation results in a locally rich fuel cloud (that is, a stratified mixture) surrounding the spark plug just before ignition. Since the flame speed is quicker in this locally rich fuel cloud, combustion occurs quicker than it would in a homogeneous cloud. The combustion process may be closer to a constant volume event rather than constant pressure event. As a result, greater engine torque may be achieved with better combustion.

As used herein, the separation refers to a number of crank angle degrees before top dead center (BTDC) at which the spark will ignite the air-fuel mixture in the combustion chamber during the compression stroke. The learned or initial separation, corresponds to an optimal separation where the peak engine output torque and the standard deviation in IMEP are acceptable at a given amount of spark advance, engine speed and load. As one non-limiting example, the initial separation may be set to 55 crank angle degrees for a given load and engine speed.

If the engine torque has not reached the first torque threshold (e.g., "NO" at 318), method 300 proceeds to 320 where the initial separation (or learned separation) is continued to be applied between the compression stroke direct injection and the spark, so that the engine torque increases to the first threshold.

Once the engine torque reaches the first threshold (e.g., "YES" at 318), method 300 proceeds to 322 where the separation is updated, herein increased, from the initial separation. In one example, increasing the separation includes advancing the compression fuel injection timing (from the initial fuel injection timing) while maintaining the spark timing (at the initial spark timing) at 324. Alternatively, the separation may be increased by retarding the spark timing (from the initial spark timing) while maintaining the compression fuel injection timing (at the initial fuel injection timing) at 326. Example separation adjustments are described at FIG. 5.

Adjusting the separation may include increasing the separation between the timing of the compression stroke direct injection and the spark timing. In one example, spark timing may be retarded while maintaining the timing of the compression stroke direct injection to increase the separation. In another example, the timing of the compression stroke direct injection may be advanced while maintaining the timing of the spark to increase the separation. The controller may incrementally increase the separation, such as by retarding the spark timing by 5 CAD at a time, or by advancing compression direct injection timing (towards compression stroke BDC) by 5 CAD at a time. A size of the incremental increase in separation may be adjusted so as to not to produce significant torque disturbances. At each incremental separation between the timing of the compression stroke direct injection and spark timing, the controller may monitor one or more engine parameters, as explained below.

Method 300 proceeds from 322 to 328 where it is determined if the engine torque has reached a second torque threshold. The second torque threshold may be set to be higher than the first torque threshold. During an exit from DFSO conditions, the controller may adjust the AFR to be richer than stoichiometry at 313. However, this rich operation increases engine output torque. This increase in torque can be offset by increasing the separation between the timing of the compression stroke direct injection and the cylinder spark event. Increasing the separation causes a decrease in engine torque. Together, operating with a richer than stoichiometric AFR and increasing the separation may result in the engine torque increasing more gradually to the second, higher threshold. In this way, torque bumps may be reduced during exit from DFSO.

If the engine torque has not reached the second torque threshold (e.g., "NO" at 328), the method proceeds to 330 where the controller continues to increase the separation between the timing of the compression stroke direct injection and the spark until the second torque threshold is reached.

Once the engine torque reaches the second torque threshold (e.g., "YES" at 328), method 300 proceeds to 332. When the engine torque has reached the second higher torque threshold, the charge distribution within the cylinder may be considered to be more homogeneous. Accordingly, the controller may transition from the first stratified injection mode to the second, homogenous injection mode. Specifically, the controller transitions from compression stroke fueling to intake stroke fueling. Method 300 ends.

Turning now to FIG. 5, map 500 illustrates example fuel injection profiles that may be applied during an exit from DFSO conditions. Map 500 illustrates an engine position along the x-axis in crank angle degrees (CAD). Different fuel injection profiles (502, 503, 505, 507, 509, 511, 513, and 515) may be applied by a controller to adjust a separation between a timing of a cylinder direct fuel injection and a spark timing when exiting a DFSO condition. Each fuel pulse (504, 508, 510, 512, 514, 516, and 518) depicts a timing of injection relative to a cylinder piston position. Fuel pulses are shown by hatched bars while spark events are represented by a star. Based on the position of the cylinder's piston at any time in the engine cycle, fuel may be injected into the cylinder during an intake stroke (I), a compression stroke (C), a power stroke (P), or an exhaust stroke (E). The numbers on the Y-axis indicate a combustion event number counted from a first event where fueling is resumed during a DFSO exit condition. For example, combustion #1 is the first fueling (and combustion) event occurring immediately after DFSO exit conditions are confirmed. In other words, combustion #1 is not the first combustion event that occurs in the drive cycle, but the first combustion event to occur in the engine immediately after DFSO exit, with no intermediate combustion event in between. Successive combustion event numbers represent successive combustion events occurring since the exit from DFSO.

During DFSO, the engine is not fueled (plot 502). When DFSO exit conditions are met (e.g., when engine speed falls below a threshold speed), the controller may reactivate the fuel injectors and resumes engine fueling. Specifically, when DFSO exit conditions are met, the controller fuels the engine during the compression stroke (fuel pulse 504). Herein, the compression stroke direct injection occurs closer to an end of the compression stroke (closer to TDC than BDC of compression stroke) and is followed by a spark event at a separation s1 from the end of the compression stroke. The separation, s1 is the separation that is learned (as shown in method 200) during a previous engine cycle (e.g., not current DFSO exit condition) when the engine was operated with compression stroke direct injection that occurred prior to the current DFSO condition (plot 502). The controller retrieves the separation, s1 from memory and applies the separation, s1 immediately after exiting DFSO. Herein, applying the separation, s1 between the compression stroke direct injection (fuel pulse 504) and the spark event (star) enables the engine torque to reach a first threshold, thereby avoiding engine stalls. As elaborated in method 300, the separation, s1 may be applied until an engine torque reaches a first torque threshold, thereafter, the separation between the compression stroke direct injection and the spark event may be increased as shown below.

During combustion event #2 (e.g., combustion event that occurs immediately after combustion event #1), the controller may increase the separation from the initial or learned separation s1 to a separation s2, as shown in fuel injection profile 505. Herein, the separation between the compression stroke direct injection (fuel pulse 508) and the spark event (star) is increased by advancing the timing of the compression stroke direct injection (fuel pulse 508) while maintaining the spark event (star). Thus, CAD2 is more advanced relative to CAD1, in this example Herein, s2 is greater than s1, where s1 is the learned separation that achieves a peak engine output torque (as elaborated in method 300).

During the next combustion event (#3), the compression stroke direct injection is further advanced to further increase the separation. Specifically, at combustion event #3, the compression stroke direct injection (fuel pulse 510) may be at separation s3 from the spark (star). Herein, CAD3 is more advanced relative to CAD2 and CAD1 (or s3>s2>s1). This continues until combustion event # (n−2) with the compression stroke direct injection advanced gradually while maintaining the spark timing (star). Thus, at combustion event #(n−2), the compression stroke direct injection (fuel pulse 512) may be at separation s(n−2) from spark (star). Thus, CAD4 is more advanced relative to each of CAD1, CAD2, and CAD3 (or s(n−2)>>s1). CAD4 is closer to the BDC than the TDC of the compression stroke, for example.

It may be appreciated that during combustion event #1 when the separation s1 is applied between the compression stroke direct injection and the spark event, a locally rich fuel cloud (stratified) surrounding the spark plug is formed just before ignition. Increasing the separation between the compression stroke direct injection and the spark events in successive combustion events (#2 until #(n−2), for example), results in dispersion of the locally rich fuel cloud. As the fuel cloud disperses, the local rich fuel cloud becomes progressively leaner. As a result of the leaning out of the stratified charge, flame speed is reduced. In some examples, the controller may slowly advance the spark to restore the original torque.

In one example, spark may be advanced based on either driver demand or feed back spark control. If the driver demands power, spark may be advanced to meet the request. As spark is advanced the end of compression may also advanced to maintain the desired separation. As the end of injection advances, the window to inject fuel decreases. If this window becomes too small (reach the minimum injector pulse width) then the controller may switch from compression stroke direct injection to intake stroke direct injection to avoid inaccurate fuel delivery. If the fuel mass becomes greater than a threshold some, if not all, of the fuel may need to be moved to intake stroke direct injection to avoid inaccurate fuel delivery.

In another example, spark may be advanced based on feed back spark control, for example without drive input. Herein, as the separation between the end of compression stroke direct injection and spark increases the actual engine output torque decreases, which may further decrease engine speed. Once the engine speed drops below desired, feed back spark control may begin to advance spark to increase engine speed to desired. Once the separation between the end of compression stroke direct injection and spark becomes greater than a threshold separation, and when the engine speed has reached the desired engine speed, the combustion process may be considered "homogeneous" and the controller may change from compression stroke direct injection to intake stroke direct injection. In this way, the transition from compression stroke direct injection to intake stroke direct injection may occur without a significant change in engine output torque.

However, as spark advances, the fuel has less time to disperse and charge returns to a stratified position. In such conditions, if the engine speed starts decreasing, the controller may restore the optimal or initial separation, s1 between the end of injection and spark to restore desired engine speed.

Alternatively, instead of advancing the compression stroke direct injection (fuel pulse 504) relative to spark, it may be possible to increase separation by retarding the spark from the original spark timing while maintaining the initial compression stroke direct injection timing as shown in map 550. As shown in fuel injection profile 515, the spark (star) may be retarded while the compression stroke direct injection (fuel pulse 504) is not changed. In this way, the separation between the compression stroke direct injection and the spark may be increased.

As the separation between the end of compression stroke direct injection and spark is increased, the charge distribution within the cylinder beings to move from away from a stratified mixture and towards a homogenous mixture. As a result, the engine torque begins to decrease. Thus, at combustion event #(n−1) shown in fuel injection profile 511, fueling is transitioned from compression stroke direct injection to intake stroke direct injection (514). In one example, the engine fueling may be transitioned from compression injection to intake injection when the separation between the compression injection and the spark reaches a threshold separation. For example, the threshold separation may be s(n−1), wherein s(n−1) is greater than the initial separation, s1 between the compression stroke direct injection and the spark (as shown in fuel injection profile 503). Further, a separation between the intake stroke direct injection (514) and spark may be adjusted based on engine operating conditions such as engine load, engine speed, engine temperature, air/fuel ratio, and the like. In some examples, depending on the engine operating conditions, compression stroke direct injection (fuel pulse 518) may be used in addition to intake stroke direct injection (fuel pulse 516). As an example, the intake stroke injection (plot 516) may be leaner than stoichiometry, and the compression stroke injection (plot 518) may be richer than stoichiometry to achieve rich combustion conditions at the spark plug to reduce spark plug fouling.

In summary, when the engine exits DFSO, the engines torque goes from negative (fuel off) to positive (fuel on). This creates a noticeable torque bump that passes through the drivetrain and can be perceived by the driver. However, by using the first injection mode with fuel directly injected during the compression stroke, and further increasing the separation between the compressive injection and the spark, torque bumps while exiting DFSO may be reduced. Once a desired separation between the end of injection and spark is achieved, the charge may be more homogeneous and the controller transitions from compressive fueling to intake fueling. In this way, a smoother transition may be possible when exiting DFSO without any torque bumps.

Turning now to FIG. 4, map 400 shows an example of learning a separation between a compression stroke direct injection and a spark prior to a DFSO condition, and applying the learned separation during a subsequent exit from DFSO conditions. Plots 402 and 432 show engine torque during different sets of conditions (e.g., prior to DFSO and during an exit from DFSO). Plots 404 and 436 show operation of the engine in different injection modes during the corresponding conditions. Plots 406 and 438 show the separation between the compression stroke direct injection and the spark while plots 408 and 440 show an engine speed during the corresponding conditions. Plots 410 and 442 show charge distribution while plots 412 and 444 show an overall air/fuel ratio (AFR) during the corresponding conditions mentioned above. For each plot, time is depicted along the x (horizontal) axis while values of each respective parameter are depicted along the y (vertical) axis.

Between time t0 and t1, the engine operates with fuel directly injected during the intake stroke (plot 404). With intake stroke direct injection, charge distribution (plot 410) in the cylinder is more homogeneous (plot 428). When fuel in injected during the intake stroke, fuel mixes with the air in such a way that the charge distribution occurring within the cylinder is uniform or unvarying or homogeneous throughout the whole volume of inside the cylinder. As a result of the uniform mixing, there may be no lean or rich pockets of fuel inside the cylinder. Therefore, when ignition occurs, all of the charge within the cylinder ignites and burns with equal efficiency and the flame created by the initial combustion spreads more effectively through the whole mixture.

Between time t0 and t1, when the engine is fueled via intake stroke direct injection, an overall AFR (plot 412) may be at or around the stoichiometric air/fuel ratio 430. However, depending on engine operating conditions (such as engine speed, engine torque, engine temperature, engine load, etc.), it may be possible to operate the engine via intake stroke direct injection so that the overall AFR is within a range (e.g., 11:1 to 15:1). For example, if there is higher operator torque demand, the engine may be operated with a richer than stoichiometry overall AFR (e.g., 11:1) until the torque demand is met. Thereafter, the overall AFR may be adjusted to or near stoichiometry. During some operating conditions when increased fuel economy is desired, the controller may operate the engine with fuel injected during the intake stroke with a leaner than stoichiometry overall AFR (e.g., 15:1).

Between t1 and t3, the engine may encounter light load conditions. Herein, an engine speed (plot 408) stays below a first threshold speed 424. As a result, engine fueling may be transitioned from intake stroke direct injection to compression stroke direct injection (plot 404) at time t1. In addition, the engine may be continued to be operated with compression stroke direct injection until the engine speed (plot 408) reaches the first threshold speed 424. Thus, between t1 and t3, the engine is fueled using compression stroke direct injection.

With compression stroke direct injection (also known as stratified mode), fuel is injected close to an end of a compression stroke resulting in a more stratified charge distribution (plot 426). Herein, a small isolated pocket or cloud of air/fuel mixture is created within the cylinder right below the spark plug, thereby forming a locally rich stratified charge distribution. Even though the AFR is rich in the stratified cloud, the overall AFR (plot 412) may be leaner than stoichiometry 430 when the engine is fueled using compression stroke injection. As an example, the engine may be fueled with compression stroke direct injection and intake air may be adjusted to achieve an overall AFR that is within a range of 11:1 to 40:1. Herein, the rich operation may be needed to restore/maintain catalyst conversion efficiencies In addition to fueling during the compression stroke, the controller may additionally adjust a separation (plot 406) between the timing of compression stroke direct injection and a spark event. At time t1, when the engine fueling is switched from intake stroke direct injection to compression stroke direct injection, the separation (plot 406) may be set to a threshold separation 421. The threshold separation may be set based on one or more of the engine speed (plot 408), and the engine torque (plot 402).

Between t1 and t2, the separation (plot 406) between the compression stroke direct injection and the spark may be increased. As the separation (plot 406) increases, the engine torque (plot 402) begins to increase until it reaches a threshold torque 414, and thereafter as the separation (plot 406) is continued to be increased, the engine torque (plot 402) begins to decrease. Specifically, the engine torque increases until an optimal separation (or threshold torque 414) is reached. Once the optimal separation is reached, any further increase in separation causes the torque to decrease.

At t2, the controller learns that the engine torque (plot 402) produced at the separation (marker 416) is a peak engine output torque. This separation (marker 416) and the threshold torque or peak engine output torque (414) is saved in the controller's memory. The controller retrieves the learned separation and the peak engine output torque during other engine operating conditions (e.g., during DFSO exit) as shown below.

At time t3, the engine exits the light load condition, and the engine speed (plot 408) rises above the first threshold speed 424. In one example, the engine fueling may be transitioned back to intake stroke direct injection (plot 404) to meet the increasing the engine load requirements. In other examples, the engine fueling may be maintained in compression stroke direct injection for a certain time, and then transitioned to the intake stroke direct injection based on engine operating conditions.

Thus, the separation between the compression stroke direct injection and the spark that produces peak engine output torque is learned during engine cycles when compression stroke direct injection is used for fueling. In one example, the controller may learn the separation every time the engine is fueled using compression stroke injection, and accordingly update the value stored in memory. In another example, the controller may learn the separation when a certain time has elapsed since the last learning.

Another engine operation in the same drive cycle is shown between time t4 and t8. Specifically, between t4 and t5, the engine is in a deceleration fuel shut-off (DFSO) condition. During DFSO condition, the fuel injectors are disabled and the engine is not fueled. Since the engine is not fueled, the overall AFR (plot 444) may be determined to be lean. In addition, during DFSO, the engine is decelerated (indicated by engine speed (plot 440) decreasing) and the engine torque (plot 432) may be low.

At time t5, the engine speed (plot 440) falls below a second threshold speed 450. In one example, the second threshold speed 450 may be lower than the first threshold speed 424 used during previous light load engine cycle. In other examples, the first threshold speed 424 may be the same as or different from the threshold speed 424 used during previous engine cycle. When the engine speed (plot 440) falls below the second threshold speed 450, DFSO exit conditions are considered met, and engine fueling may be resumed.

When engine fueling is resumed, a sudden jump in torque (plot 434) may be experienced. This noticeable torque bump passes through the drivetrain and can be perceived by the driver. The inventors have recognized that it may be possible to avoid the torque bump during a DFSO exit by transitioning from compression stroke injection to intake stroke injection by increasing the separation between the timing of compression injection and the spark event, as discussed below.

Immediately after DFSO exit at t5, the engine is fueled using compression stroke direct injection (plot 436). In addition, the separation (plot 422) that was learned during the previous compression stroke direct injection (between time t1 and t2) is now applied between time t5 and t6. When the separation (plot 438) is maintained at the learned separation or threshold separation 422, the engine torque reaches the first threshold 414. Herein, the first threshold is the peak engine output threshold determined during time t1 and t2. Once the engine torque reaches the first threshold 414, the separation 438 may be gradually increased between t6 and t7.

When the engine exits DFSO, emissions may be degraded. During DFSO when there is no fueling, exhaust may be oxygen rich. As a result, a three-way catalyst (TWC) may need to reestablish NOx conversion efficiencies when the DFSO is exited and fueling is resumed. One way to reactivate the catalyst is to operate the engine with AFR (plot 444) set to be richer than stoichiometry. This rich operation increases engine output torque, making a torque bump more noticeable. However, to counter this sudden increase in torque, the separation (plot 438) between the compression stroke direct injection and the spark may be gradually increased.

When the separation (plot 438) is increased while maintaining overall AFR near stoichiometry or lean, the engine torque (plot 448) starts decreasing. Thus, the net effect of increasing the separation while maintaining an overall rich AFR is that engine torque (plot 432) increases more gradually. In this way, sudden torque bumps that would otherwise be experienced during a DFSO exit may be reduced.

In one example, the controller may delay the rich AFR action until the engine torque reaches the first threshold (414). As an example, the engine may be operated close to stoichiometry from time t5 to t6, and then at t6, the engine may be operated with rich AFR. The delaying of rich AFR operation may increase the engine torque more gradually during the DFSO exit.

Increasing the separation (plot 438) between compression stroke direct injection and spark causes the charge distribution (plot 442) to gradually become more homogeneous or less stratified. At t7, the charge distribution (plot 442) may be closer to a homogeneous distribution. Further, at t7, the engine torque reaches a second, higher threshold (415). When the engine torque (plot 432) reaches the second threshold (415), the engine may be transitioned from compression stroke injection to intake stroke injection (436). In one example, the second threshold (415) may be determined based on the charge distribution becoming more homogeneous.

Between t7 and t8, the engine is fueled using intake stroke injection (plot 436) and with the overall AFR (plot 444) maintained closer to stoichiometry (430). Additionally, an injection timing of the intake stroke injection and an amount of fuel injected may be adjusted based on engine speed (plot 440) and engine torque (plot 432). It may be appreciated that the AFR (plot 412) used between time t1 and t3 when the engine was fueled using the compression stroke direct injection is leaner than the overall AFR (plot 444) used between time t5 and t7.

In this way, during an exit from DFSO conditions, a separation between the end of a compression stroke fuel injection and a spark timing may be gradually increased to gradually increase the net engine torque and avoid torque bumps. Specifically, increasing the separation between the compression stroke direct injection and the spark event changes the charge distribution. Since the fuel disperses slowly, there is a region where the mixture is not quite as rich as it once was but not as lean as a homogeneous mixture. Given that the mixture around the plug is dispersing, the locally rich mixture is also leaning out. This leaning out reduces the flame speed, which reduces torque. As such, this reduction in torque counters the increase in torque that is experienced due to richer AFR that is used during a DFSO exit in order to control reactivate an oxygen saturated exhaust catalyst. The technical effect of increasing the separation between the compression stroke direct injection and the spark during DFSO exit is that the engine torque begins to drop. As such, the reduction in engine torque caused by increasing the separation may oppose the increase in engine torque that occurs as a result of operating the engine with a rich air fuel ratio (AFR) (to increase efficiency of exhaust catalysts). Thus, instead of encountering a huge torque bump, the engine now experiences a gradual increase in torque, thereby making the transition in engine torque more gradual during DFSO exit.

The systems and methods described above provide for a method of comprising during an exit from a deceleration fuel shut-off (DFSO) condition, fueling an engine via a compression stroke direct injection (DI) at a first separation from a spark event until an engine torque reaches a first threshold, then increasing a separation between the compression stroke DI and the spark event until the engine torque reaches a second, higher threshold and thereafter transitioning engine fueling to an intake stroke DI. In a first example of the method, the method may additionally or alternatively include wherein the first separation is a learned separation, learned during a previous compression stroke DI fueling of the engine occurring prior to the DFSO condition. A second example of the method optionally includes the first example, and further includes wherein the engine torque is a net engine output torque and wherein the first separation provides a peak engine output torque that maintains an integrated mean effective pressure of an engine cylinder within a threshold pressure. A third example of the method optionally includes one or more of the first and the second examples, and further includes wherein prior to the exit from the DFSO condition, the engine is decelerated with fuel injectors shut off.

A fourth example of the method optionally includes one or more of the first through the third examples, and further includes wherein the separation includes a difference between a timing between fuel injecting timing and a timing of the spark event, and wherein increasing the separation includes advancing the compression stroke DI while maintaining the timing of the spark event. A fifth example of method optionally includes one or more of the first through the fourth examples, and further includes wherein increasing the separation includes retarding a timing of the spark event while maintaining a timing of the compression stroke DI. A sixth example of method optionally includes one or more of the first through the fifth examples, and further includes wherein fueling the engine via the intake stroke DI includes fueling the engine during an intake stroke of an engine cycle, a timing of the intake stroke DI more advanced from a bottom dead center of a piston in the intake stroke than the compression stroke DI from a top dead center of the piston in a compression stroke. A seventh example of method optionally includes one or more of the first through the sixth examples, and further includes wherein an overall air-fuel ratio (AFR) of the engine during the compression stroke DI during exit from DFSO condition is richer than the overall AFR of the engine using compression stroke DI prior to exit from DFSO condition.

The systems and methods described above also provide for a method comprising operating an engine in a first injection mode prior to a deceleration fuel shut-off (DFSO) condition with fuel injected in a compression stroke to learn an initial separation between a timing of a compression stroke direct injection and a timing of a spark for an engine torque to reach a first torque threshold, applying the initial separation and operating the engine in the first injection mode during an exit from DFSO condition to reach the first torque threshold, increasing a separation between the timing of the compression stroke direct injection and the timing of the spark to increase the engine torque, and when the engine torque reaches a second, higher torque threshold, transitioning the engine from the first injection mode to a second, different injection mode with fuel injected during an intake stroke. In a first example of the method, the method may additionally or alternatively include wherein the first injection mode prior to DFSO condition includes an air-fuel ratio (AFR) leaner than the first injection mode during the exit from DFSO. A second example of the method optionally includes the first example, and further includes wherein transitioning the engine from the first injection mode to the second injection mode occurs when the separation reaches a threshold separation, the threshold separation larger than the initial separation.

A third example of the method optionally includes one or more of the first and the second examples, and further includes wherein the first torque threshold is a peak desired engine output torque when an indicated mean effective pressure (IMEP) of a cylinder is within a threshold pressure. A fourth example of the method optionally includes one or more of the first through the third examples, and further includes determining the first torque threshold based on one or more of an engine load, an engine speed, and a spark advance. A fifth example of the method optionally includes one or more of the first through the fourth examples, and further includes wherein the separation is a difference between the timing of the compression stroke direct injection and the timing of a spark and increasing the separation includes advancing the timing of the compression stroke direct injection while maintaining the timing of the spark. A sixth example of the method optionally includes one or more of the first through the fifth examples, and further includes wherein increasing the separation includes retarding the timing of the spark while maintaining the timing of the compression stroke direct injection.

The systems and methods described above provide for a system for a vehicle, comprising an engine, a direct injector coupled to a cylinder of the engine, a spark plug, an exhaust oxygen sensor, an engine speed sensor configured to measure an engine speed, and a controller with computer-readable instructions stored on non-transitory memory for: during a fueling event before a deceleration fuel shut-off (DFSO) condition, learn a first separation between a compression stroke direct fuel injection and a spark timing of the spark plug to achieve a target torque, apply the first learned separation to achieve the target torque after an exit from DFSO condition when an engine speed falls below a first speed threshold; and increase a separation between the compression stroke direct fuel injection and the spark timing from the first learned separation to a second, larger separation between the compression stroke direct fuel injection and the spark timing and then transitioning engine fueling to an intake stroke direct fuel injection. In a first example of the system, the system may additionally or alternatively include wherein the compression stroke direct fuel injection occurs at an end of a compression stroke. A second example of the system optionally includes the first example, and further includes wherein a charge distribution in the cylinder is richer when operating the engine using the compression stroke direct fuel injection, and wherein the charge distribution is leaner when operating the engine using the intake stroke direct fuel injection. A third example of the system optionally includes one or more of the first and the second examples, and further includes wherein the controller includes further instructions for: determining the target torque based on one or more of the engine speed, an engine load, and an indicated mean effective pressure (IMEP) of the cylinder before the DFSO condition occurs. A fourth example of the system optionally includes one or more of the first through the third examples, and further includes wherein the controller includes further instructions for: transitioning the engine fueling to the intake stroke direct fuel injection when the engine speed rises above a second, larger speed threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during an exit from a deceleration fuel shut-off (DFSO) condition, fueling an engine via a compression stroke direct injection (DI) at a first separation from a spark event until an engine torque reaches a first threshold, then increasing a separation between the compression stroke DI and the spark event until the engine torque reaches a second, higher threshold and thereafter transitioning engine fueling to an intake stroke DI, wherein the first separation is a learned separation, learned during a previous compression stroke DI fueling of the engine occurring prior to the DFSO condition, and wherein the previous compression stroke DI fueling of the engine occurs during lean fueling of the engine.

2. The method of claim 1, wherein the engine torque is a net engine output torque and wherein the first separation provides a peak engine output torque that maintains an integrated mean effective pressure of an engine cylinder within a threshold pressure.

3. The method of claim 1, wherein, prior to the exit from the DFSO condition, the engine is decelerated with fuel injectors shut off.

4. The method of claim 1, wherein the separation includes a difference between a timing between fuel injection timing and a timing of the spark event, and wherein increasing the separation includes advancing the compression stroke DI while maintaining the timing of the spark event.

5. The method of claim 1, wherein increasing the separation includes retarding a timing of the spark event while maintaining a timing of the compression stroke DI.

6. The method of claim 1, wherein fueling the engine via the intake stroke DI includes fueling the engine during an intake stroke of an engine cycle, a timing of the intake stroke DI more advanced from a bottom dead center of a piston in the intake stroke than the compression stroke DI from a top dead center of the piston in a compression stroke.

7. The method of claim 1, wherein an overall air-fuel ratio (AFR) of the engine during the compression stroke DI during the exit from the DFSO condition is richer than an overall AFR of the engine during the previous compression stroke DI fueling of the engine prior to the exit from the DFSO condition.

8. A method, comprising:

operating an engine in a first injection mode prior to a deceleration fuel shut-off (DFSO) condition with fuel injected in a compression stroke to learn an initial separation between a timing of a compression stroke direct injection and a timing of a spark for an engine torque to reach a first torque threshold, wherein operating the engine in the first injection mode prior to the DFSO condition comprises fueling the engine with a lean overall air-fuel ratio;

applying the initial separation and operating the engine in the first injection mode during an exit from the DFSO condition to reach the first torque threshold, wherein operating the engine in the first injection mode during the exit from the DFSO condition further comprises fueling the engine with an overall air-fuel ratio richer than the lean overall air-fuel ratio;

increasing a separation between the timing of the compression stroke direct injection and the timing of the spark to increase the engine torque; and when the engine torque reaches a second, higher torque threshold, transitioning the engine from the first injection mode to a second, different injection mode with fuel injected during an intake stroke.

9. The method of claim 8, wherein transitioning the engine from the first injection mode to the second injection mode occurs when the separation reaches a threshold separation, the threshold separation larger than the initial separation.

10. The method of claim 8, wherein the first torque threshold is a peak desired engine output torque when an indicated mean effective pressure (IMEP) of a cylinder is within a threshold pressure.

11. The method of claim 8, further comprising determining the first torque threshold based on one or more of an engine load, an engine speed, and a spark advance.

12. The method of claim 8, wherein the separation is a difference between the timing of the compression stroke direct injection and the timing of the spark and increasing the separation includes advancing the timing of the compression stroke direct injection while maintaining the timing of the spark.

13. The method of claim 8, wherein increasing the separation includes retarding the timing of the spark while maintaining the timing of the compression stroke direct injection.

14. A system for a vehicle, comprising:

an engine;

a direct injector coupled to a cylinder of the engine;

a spark plug;

an engine speed sensor configured to measure an engine speed; and a controller with computer-readable instructions stored on non-transitory memory for:

during a fueling event before a deceleration fuel shut-off (DFSO) condition wherein the engine is fueled with a lean overall air-fuel ratio, learning a first separation between a compression stroke direct fuel injection and a spark timing of the spark plug to achieve a target torque;

applying the learned first separation to achieve the target torque responsive to the engine speed falling below a first speed threshold after an exit from the DFSO condition; and increasing a separation between the compression stroke direct fuel injection and the spark timing from the learned first separation to a second, larger separation between the compression stroke direct fuel injection and the spark timing and then transitioning engine fueling to an intake stroke direct fuel injection.

15. The system of claim 14, wherein the compression stroke direct fuel injection occurs at an end of a compression stroke.

16. The system of claim 14, wherein a charge distribution in the cylinder is richer when operating the engine using the compression stroke direct fuel injection, and wherein the charge distribution is leaner when operating the engine using the intake stroke direct fuel injection.

17. The system of claim 14, wherein the controller includes further instructions for determining the target torque based on one or more of the engine speed, an engine load, and an indicated mean effective pressure (IMEP) of the cylinder before the DFSO condition occurs.

18. The system of claim 14, wherein the controller includes further instructions for transitioning the engine fueling to the intake stroke direct fuel injection when the engine speed rises above a second, larger speed threshold.

* * * * *